United States Patent [19]

Schreyer et al.

[11] Patent Number: 4,463,933

[45] Date of Patent: Aug. 7, 1984

[54] CLUTCH/BRAKE MECHANISM

[75] Inventors: Kenneth D. Schreyer, Clarence; Alton H. Cooper, Kenmore, both of N.Y.

[73] Assignee: Columbus McKinnon Corporation, Amherst, N.Y.

[21] Appl. No.: 437,131

[22] Filed: Oct. 27, 1982

Related U.S. Application Data

[62] Division of Ser. No. 210,178, Nov. 25, 1980, abandoned.

[51] Int. Cl.[3] ..... B66D 3/02

[52] U.S. Cl. ..... 254/368; 254/369; 254/378; 188/71.1; 188/83; 188/218 XL; 192/107 R

[58] Field of Search ..... 254/369, 368, 350, 351, 254/304, 305, 319, 378, 379, 344; 188/73.2, 259, 250 B, 218 XL, 71.1, 83, 218 A; 192/107 R, 70.14, 18 R, 111 A, 10, 52, 53 C; 464/42, 43, 45, 46

[56] References Cited

U.S. PATENT DOCUMENTS

| | | | |
|---|---|---|---|
| Re. 14,933 | 8/1920 | Lake | 192/18 R X |
| 835,373 | 11/1906 | Stacks | 192/70.15 |
| 860,590 | 7/1907 | Williams | 192/70.23 |
| 986,311 | 3/1911 | Pollock | 464/45 X |
| 2,135,126 | 11/1938 | Harwood | 192/70.14 X |
| 2,608,107 | 8/1952 | Robins et al. | 74/578 |
| 2,894,610 | 7/1959 | Harrington | 192/16 |
| 3,056,480 | 10/1962 | Carroll | 192/16 |
| 3,138,231 | 6/1964 | Lock | 192/16 |
| 3,258,248 | 6/1966 | Lerch et al. | 254/369 |
| 3,825,100 | 7/1974 | Freeman | 254/378 X |
| 4,251,060 | 2/1981 | Suzuki et al. | 192/16 X |
| 4,299,311 | 11/1981 | Shirai et al. | 188/218 XL |

*Primary Examiner*—John M. Jillions

*Attorney, Agent, or Firm*—Bean, Kauffman & Bean

[57] ABSTRACT

There is disclosed a clutch/brake mechanism of the "disc" type wherein the coacting friction producing members are severally configured of frusto-conical and planar form whereby sealing contact is maintained at the peripheral surfaces thereof when in a brake-released condition to thereby prevent entrance of external contaminants into the brake-clutch mechanism.

2 Claims, 3 Drawing Figures

CLUTCH/BRAKE MECHANISM

This application is a division of U.S. Ser. No. 210,178 filed Nov. 25, 1980, now abandoned.

BACKGROUND AND OBJECTS OF THE INVENTION

This invention relates generally to improvements in clutch-brake mechanisms; and has specific application to load hoisting or pulling, or so-called "come-along" lever-operated "ratchet hoists" or "pullers". Such devices are manually operated for raising and lowering loads, tensioning wires or cables, and the like; and are disclosed for example in U.S. Pat. Nos. 2,608,107 and 2,243,361. Such tools are so constructed that whenever the load is not being taken directly by the manually operated lever, the load is sustained independently of the operating lever by reason of automatic operation of friction clutch-brake means incorporated within the mechanism. However, the invention is similarly applicable to motor driven hoists or the like.

Such mechanisms are typically called upon to operate in dusty, dirty, wet and/or muddy environments. By way of example, they are dropped upon and dragged across coal mine floors; building construction sites; and the like. Such exposures contribute to early deterioration and reduced life of the friction pad and metal plate portions of such mechanisms.

The primary object of the present invention is to provide an improved clutch-brake friction pad/plate construction, whereby the mechanism per se substantially prevents ingress of abrasive materials from externally thereof, and at the same time provides throughout its operational life maximum mechanical advantage for its operational purposes. Incident thereto, the invention improves the wearing life of the mechanism. These objects are accomplished by novelly shaping (with respect to their sectional configurations) the frictionally engaging members of the unit, whereby the system is kept clear of contaminants from externally thereof such as would otherwise foul the relatively moving friction supplying parts. In consequence, the mechanism performs at all times at optimum mechanical advantage, and is continuously reliable and is of longer wearing operational life.

Prior arrangements known to applicant which are designed to exclude entrance of external dirt, etc. into such mechanisms are disclosed in U.S. Pat. Nos. 1,684,185; 2,739,789; 3,056,480 and 4,156,521.

As distinguished from the above, the co-acting friction supply surfaces of the present invention are uniquely (sectionally) shaped, and are so arranged relative to the clutch-brake disc members as to prevent entrance of foreign materials from externally thereof into relatively moving parts of the mechanism when the clutch/brake mechanism is inoperative. Supplementary spring pressure supply means is also preferably provided in order to augment the external contaminant sealing operation as explained hereinabove. Hence, a more efficient and longer wearing, yet overall compact mechanism is provided.

THE DRAWINGS

In the drawing herewith:

SPECIFICATION

Figure 1:
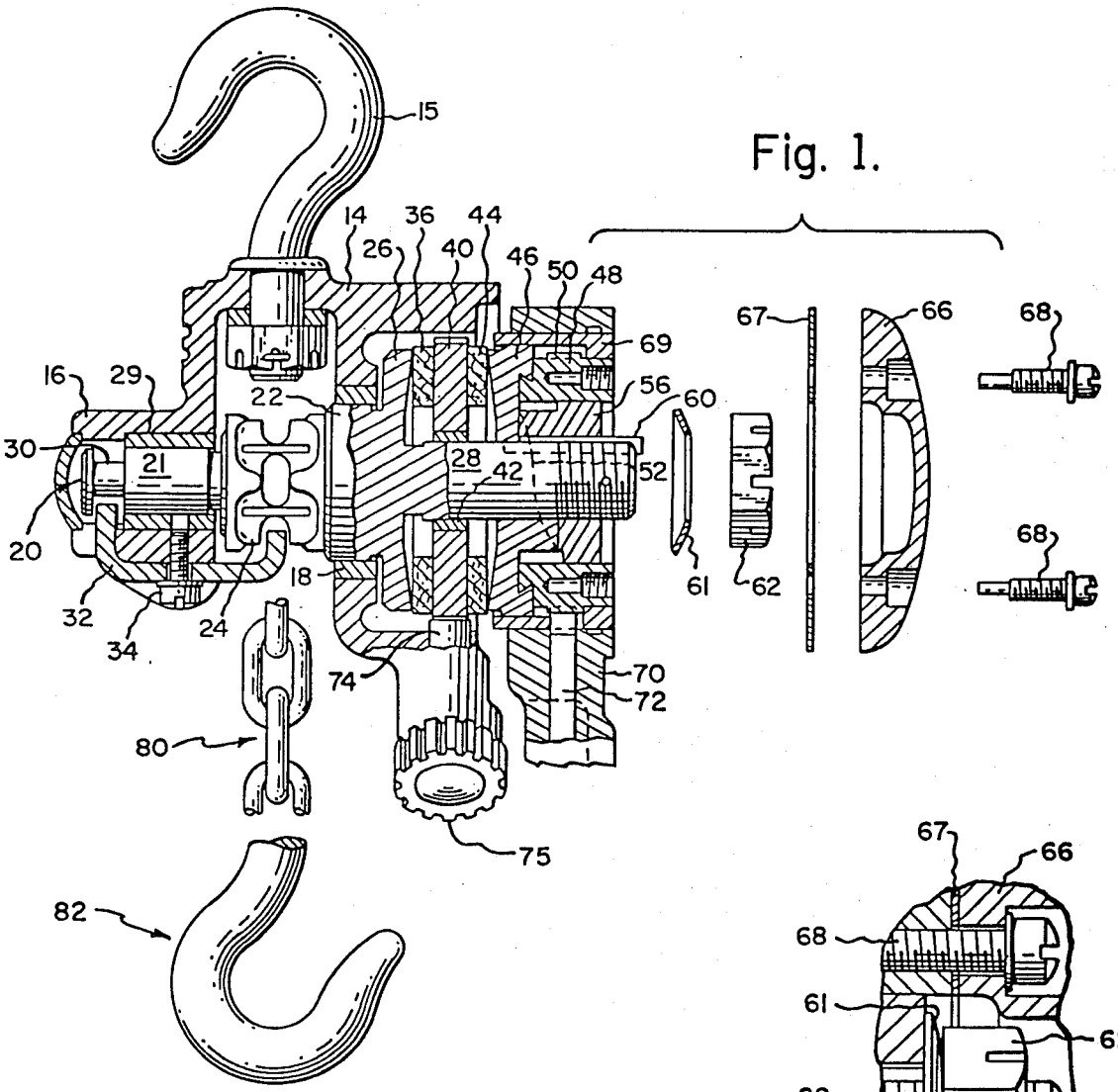
FIG. 1 is a sectional (partly "exploded") view of a lever operated hoist or puller device embodying by way of example an improved system of the invention.
Figure 2:
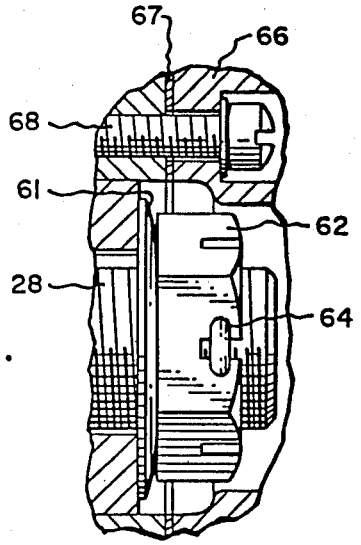
FIG. 2 is a fragmentary enlarged scale view of the "exploded" parts of FIG. 1 shown in their subsequently assembled relation.

The invention is illustrated herein by way of a presently preferred example as being incorporated in a hoist or puller mechanism of the type shown in U.S. Pat. Nos. 2,608,107 and 3,258,248. Therefore, the mechanism is shown generally to include a frame 14 mounting a support hook 15. The frame carries bearings 16, 18 in which are journaled the hoist load lift wheel shaft 20. As in the references hereinabove described, this shaft 20 includes a reduced diameter portion 21 disposed within the bearing 16; an enlarged portion 22 disposed within the larger diameter bearing 18; a lift wheel portion 24; a face plate portion 26; and an opposite reduced diameter end portion 28. The bearing 16 is set against a shoulder 29 of the frame structure to transmit end thrust loads thereagainst, and thus the lift wheel 24 transmits end thrust loads toward the left as viewed in FIG. 1, and against the bearing 16 which is anchored in the frame.

The extreme left end portion of the shaft 20 is grooved as indicated at 30, and a U-shaped bracket 32 is bolted to the frame as by means of a bolt 34; one end of the bracket 32 being thereby disposed within the groove portion 30 of the shaft to prevent accidental disassembly of the shaft from the frame. The other end of the bracket 32 turns upwardly into the centrally grooved portion of the lift wheel element 24 to function as a chain stripper, as is well known in the hoist art. However in the case of the present invention, generally annular friction discs 36 are cemented to opposite surfaces of an externally toothed ratchet wheel 40 which is rotatably mounted upon the shaft portion 28 by means of a bushing 42. A lever ratchet hub or plate 46 is rotatably mounted upon the shaft portion 28 in opposition to the ratchet wheel 40. The hub 46 carries with it a ratchet wheel portion 48 which is externally toothed as indicated at 50. As set forth in the referenced patents, the ratchet hub 46 has formed integrally therewith a helically cam shaped surface 52, and a complementary shaped cam surface 56 which is mounted adjacent the outer end of the shaft portion 28 and is keyed thereto as at 60. The cam surfaces are arranged so that the hub and cam members 46, 56 are complementary at the surfaces of contact therebetween, whereby relative rotational movements therebetween will force the ratchet hub 46 to be displaced axially relative to the cam 56. This general arrangement of parts is old in the art; being shown and described, for example, in further detail in U.S. Pat. No. 2,608,107.

In the case of the present invention, however, the cam surface 56 is preferably axially biased against movement toward the right as viewed in FIG. 1 relative to the shaft 28 as by means of a "belleville" type spring washer 61 disposed under a threaded nut 62 which is locked in position such as by a cotter pin 64. This spring 61 insures that at all times after assembly of the device the friction related parts of the mechanism remain in outside contaminant precluding relationship, as will become apparent hereinbelow. As shown herein by way of further example, cover plate 66 and seal ring 67 are bolted by means of screws 68 to the lever ratchet member 48 so as to enclose the mechanism subsequent to assembly thereof. A second cover plate is sandwiched into the opposite end of the housing to enclose the latter.

As in the case of the aforesaid U.S. Pat. No. 2,608,107, the lever ratchet hub and ratchet wheel unit 46, 48 thereof may be, as shown, encircled by an annular wear-resistant bushing 69 about which is cast the hub portion of the hoist operating lever 70 which carries a plunger 72 which is normally biased by means of a spring (not shown) so as to move it into meshed engagement with the ratchet wheel 48, as is conventional in the art. Also, in this case the plunger 72 is so shaped at its upper end as to cooperate with the ratchet wheel 48 to block relative movement of the lever 70 and the ratchet wheel 48 in one direction, while permitting the ratchet wheel 40 to cam the plunger 72 out of blocking position for rotation of the lever 70 in the opposite direction. However, the plunger 72 is arranged to be manually reversible in attitude whereby the operator may withdraw and rotate it through 180 degrees so as to reengage the wheel 48 to block movement of the lever relative to the ratchet wheel in the opposite direction.

Thus, oscillation of the lever 70 will either raise or lower the load, according to the setting of the plunger 72. Also, a pawl member 74 and its operating knob 75 is furnished, to normally engage the brake ratchet wheel 40 and hold it stationary relative to the frame 14. However, in order to permit the lift wheel 24 to "free-wheel" (so as to permit slack chain to be manually drawn through the device) the knob 75 is pulled out against the action of a spring (not shown) and rotated 90 degrees to rest upon an abutment. The plunger 72 is also withdrawn and rotated into a position midway of its "up" and "down" positions; thus permitting the shaft/lift wheel assembly to freely rotate, as explained in the aforesaid patent. Accordingly, these features are no part of the present invention.

As explained hereinabove, such devices typically include a load lift (or pull) chain such as is shown at 80 which trains around the lift wheel 24 and carries a load engaging hook such as shown at 82. Thus, preliminary to hoisting or pulling against a load, the device is typically hung or attached by means of the hook 15 upon some stationary anchor means at such position that it will be convenient to manually operate the lever 70 with oscillatory motions with the load chain 80 extending therefrom into connection with the load. It is then usually desirable to take the slack out of the load chain prior to levering the handle 70 as explained hereinabove.

The ratchet device is then permitted to return to engagement with its ratchet wheel whereupon manual reciprocation of the handle 70 will cause the ratchet wheel 48 to rotate along with the brake hub portion 46. As the helically formed surfaces of the members 46, 56 relatively rotate, they cause the hub 46, together with the ratchet wheel 40 and the friction discs 36, 44 to be forced endwise together toward the left as viewed in FIG. 1; and thus into mutually pressure-bearing relation against the face plate portion 26. This causes the friction surfaces to become operatively engaged so as to force the load lift wheel portion 24 of the shaft to rotate along with the lever 70. At the same time, the friction between the clutch-brake elements will be sufficient to sustain the load when the operating handle 70 is being manually moved backwardly intermittently of each pulling stroke thereof. Again note that this type operation is disclosed and explained in the referenced U.S. patents, and is not claimed as a part of this invention.

The present invention relates to the two-fold problem of obtaining maximum mechanical advantage characteristics for the clutch-brake friction producing parts, and at the same time preventing entrances of dust, grit, etc. in between the brake friction discs and their oppositely wearing surfaces. In prior art devices of this type, the clutch-brake systems alternately compress and open so as to inhale abrasive dust materials, such as are detrimental to reliable operation of the device as well as to the life of the mechanism parts.

Figure 3:
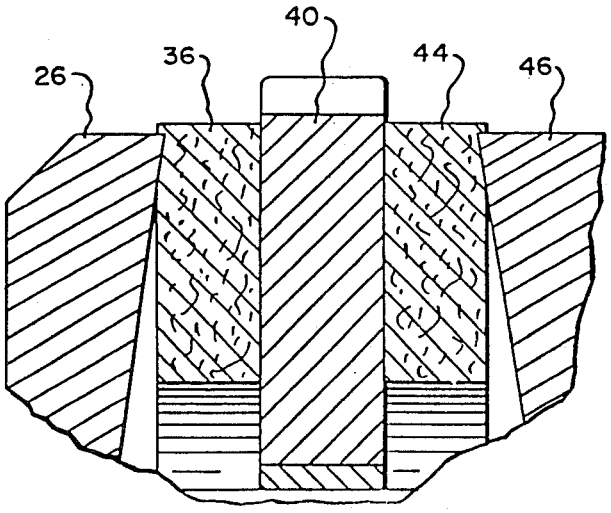
FIG. 3 is an enlarged fragmentary sectional view of the ratchet wheel and friction pad arrangement of FIG. 1.

As more clearly seen in FIG. 3, the object of the present invention may be accomplished by shaping the face plates 26 and 46 of dish-like inverse-conically surfaced form whereas the ratchet wheel 40 and the friction discs 36 and 44 are of flat-surfaced forms and are cemented together so as to rotate as a unit. Thus it will be apparent that the conically surfaced portions of the face plates will continuously provide maximum mechanical advantage for the operating clutch-brake parts while at the same time dirt-sealing the interior of the system progressively throughout the lives of the parts.

More specifically, as clearly shown in FIG. 3, the face plates 26 and 46 have annular surface areas adjacent the outer periphery thereof which dig into their respective friction discs 36 and 44 along an annular surface area of each disc inwardly of the outer peripheral or perimetric surfaces thereof, whereby an annular peripheral portion of each disc overlaps and sealingly abuts such perimetric surfaces to thereby prevent the ingress of dirt and the like between the plates and the discs. This sealing contact is maintained at all times throughout the operating lives of discs 36 and 44, even when axial forces are removed to release the clutch-brake assembly.

Supplemental to the cam arrangement referred to above, as shown in the drawings herewith, a compact "belleville" type spring washer 61 is provided to thrust the brake unit parts together. Accordingly, although the hoist/puller lever operations alternately tend to release and press together the friction pads and their opposite wearing surfaces, the spring washer 61 continuously prevents an actual separation of the clutch-brake parts such as would permit inadvertent entrance of environmental dust/grit materials or the like into the system. Thus, when lever 70 is actuated causing the ratchet hub 46 to be displaced axially relative to the cam 56 to release the brake-clutch mechanism and permit relative rotation of the ratchet wheel 70, dirt sealing engagement is nevertheless maintained between the friction discs and the dish-like inverse conically-shaped face plates.

Accordingly, it will be appreciated that the invention ensures maximum mechanical operating advantages for and reliable clutch-brake actions of the unit whenever called upon, while also contributing to longer life expectancies of the friction supply members of the mechanism.

What is claimed is:

1. In a lever-operated ratchet type load puller, comprising a frame having a support hook extending therefrom and a power shaft rotatably mounted in said frame and carrying a load engaging wheel thereon for load pulling and load tensioning, and hoisting and lowering operations in response to reverse rotations of said shaft; a manually operable lever rotatably mounted upon said frame to extend laterally therefrom and a cam-actuated clutch-brake means operative to intermittently interconnect said lever and said power shaft whereby said lever may be rotatably maneuvered in opposite directions for alternately pulling and releasing a load, and whereby such clutch-brake means operates to hold said power shaft against rotation intermediately of maneuvering operations of said lever; said clutch-brake means including oppositely paired relatively rotatable friction members having opposed friction surfaces which are alternately pressed together and released in response, respectively, to the application and removal of axial forces initiated by said alternate lever movements, the improvement comprising:

at least one of said opposed friction surfaces being of substantially frusto-conical configuration and the other of said opposed friction surfaces being of substantially planar configuration and so arranged that said friction surfaces maintain peripheral sealing contact when released to prevent ingress of external debris to the clutch-brake mechanism;

one of said opposed friction surfaces includes annular surface areas adjacent the outer peripheral surface thereof that dig into and are overlapped by the other of said opposed friction surfaces along an annular surface inwardly of the outer peripheral surface thereof, whereby an annular peripheral portion of said other peripheral surface overlaps and sealingly abuts said one of said opposed friction surfaces to thereby prevent ingress of dirt between said opposed friction surfaces; and spring means of sufficient force to constantly maintain said peripheral sealing contact but of insufficient force to prevent release of said friction surfaces upon removal of said axial forces.

2. In a load hoisting/pulling assembly comprising a frame having a support hook extending therefrom and a power shaft rotatably mounted in said frame and carrying a load chain engaging sprocket thereon for load pulling/hoisting and/or load releasing operations in response to reverse directionally controlled rotations of said shaft; and means for controlling said shaft to rotate in opposite directions; said means including a clutch-brake mechanism comprising oppositely paired friction members operative to interconnect said controlling means and said shaft whereby said shaft may be alternately rotated in opposite directions for pulling/raising and/or releasing/lowering a load; said oppositely paired friction members having opposed friction surfaces which are alternately pressed together and released in response, respectively, to the application and removal of axial forces initiated by said means for controlling said shaft, the improvement comprising:

at least one of said opposed friction surfaces being of substantially frusto-conical configuration and the other of said opposed friction surfaces being of substantially planar configuration and so arranged that said friction surfaces maintain peripheral sealing contact when released to prevent ingress of external debris to the clutch-brake mechanism;

one of said opposed friction surfaces includes annular surface areas adjacent the outer peripheral surface thereof that dig into and are overlapped by the other of said opposed friction surfaces along an annular surface inwardly of the outer peripheral surface thereof, whereby an annular peripheral portion of said other peripheral surface overlaps and sealingly abuts said one of said opposed friction surfaces to thereby prevent the ingress of dirt between said opposed friction surfaces; and spring means of sufficient force to constantly maintain said peripheral sealing contact but of insufficient force to prevent release of said friction surfaces upon removal of said axial forces.

* * * * *